US005368165A

United States Patent [19]

Ngyuen

[11] Patent Number: 5,368,165

[45] Date of Patent: Nov. 29, 1994

[54] BAG PACK DISPENSER SYSTEM

[75] Inventor: Tai Ngyuen, Kenner, La.

[73] Assignee: API, Inc., Metairie, La.

[21] Appl. No.: 851,813

[22] Filed: Mar. 16, 1992

[51] Int. Cl.[5] ..... B65D 1/34; B65D 6/04

[52] U.S. Cl. ..... 206/554; 206/494; 206/495; 221/45; 221/63

[58] Field of Search ..... 206/494, 495, 554; 221/26, 33, 45, 46, 48, 55, 63

[56] References Cited

U.S. PATENT DOCUMENTS

| | | | |
|---|---|---|---|
| 1,748,846 | 2/1930 | McColl | 206/494 |
| 2,604,253 | 7/1952 | Turner | 206/554 |
| 3,338,398 | 8/1967 | Altman, Jr. | 206/554 |
| 3,406,818 | 10/1968 | Barnett | 221/63 |
| 3,640,450 | 2/1972 | Lieberman . | |
| 3,896,966 | 7/1975 | Canno | 206/554 |
| 4,363,405 | 12/1982 | Christie | 206/494 |
| 4,476,979 | 10/1984 | Reimann et al. . | |
| 4,480,750 | 11/1984 | Dancy | 206/554 |
| 4,493,419 | 1/1985 | Prader et al. . | |
| 4,527,693 | 7/1985 | Membrino | 206/494 |
| 4,557,384 | 12/1985 | Membrino | 206/554 |
| 4,595,389 | 6/1986 | Lehmacher . | |
| 4,613,988 | 9/1986 | Maddock . | |
| 4,759,639 | 7/1988 | DeMatteis . | |
| 4,805,969 | 2/1989 | Heacock | 206/554 |

FOREIGN PATENT DOCUMENTS

| | | | |
|---|---|---|---|
| 2432578 | 1/1975 | Germany | 206/494 |

*Primary Examiner*—David T. Fidei

*Attorney, Agent, or Firm*—Joseph T. Regard, Ltd.

[57] ABSTRACT

A bag pack or stack dispenser system incorporating its shipping container (C) to dispense the bags using a frictional, template system (17A & 17B) to present the bag (8) in an open disposition when it is dispensed in a longitudinal direction (25). A unique thermoplastic bag is used, as part of a convenient and reliable system maintaining the alignment of the bags and previewing for greater ease in dispensing the bags on an individual basis. The template system incorporates a frictional contact surface for encouraging a bag, when being dispensed, to come out in an open disposition. The template may be made of a polystyrene bock, cardboard, etc., either independent of or emanating item container itself. The container has a removable, perforated, dispenser door (16), configured to provide convenient access to the bags (8), while encouraging communication of the bag being dispensed with the template for opening the bag during the dispensing operation. An alternative embodiment (FIG. 7) teaches the forming of a hook member (28*a*, 28*b*) on opposed ends of the open mouth side of the bag, the hook member being configured to communicate in a similarly configured hook cavity on the outer sides of the template to assist in dispensing the bag in an open disposition. A further alternate embodiment (FIGS. 8+; note particularly FIG. 10) uses a pair of vertically disposed wires extending through mating opening in the bags.

20 Claims, 7 Drawing Sheets

BAG PACK DISPENSER SYSTEM

BACKGROUND OF INVENTION

1. Field of Invention

The present invention relates to thermoplastic bag shipping and dispensing systems, and more particularly to a bag pack dispenser system which utilizes the pack's shipping container as the bag dispenser, particularly for bag dispensers used in connection with grocery bagging operations at supermarket check-out counters and the like.

The present invention also teaches a new and unique thermoplastic bag, wherein there is provided a convenient and reliable system for maintaining the bag stack in alignment and providing for greater ease in dispensing the bags on an individual basis.

The present invention further teaches a unique template system configured to maintain the bag stack in an aligned condition in the container. The template is further constructed to incorporate an frictionally enhanced contact surface for "encouraging" a bag when being dispensed to be dispensed in an open disposition. The template may be made of, for example, a polystyrene foam block (e.g. Styrofoam®), or other suitable material, or may be formed of cardboard, or can be emanating from the container or be provided as a separate unit.

The container of the present invention has formed therein a removable dispenser "door", configured and located to provide convenient access to the contained bags in a stack, while encouraging communication of the bag being dispensed with the template, to cause the bag to be dispensed in an open disposition, ready for the loading of groceries or the like.

An alternative embodiment of the present invention teaches the forming of a hook member on opposed ends of the open mouth side of the bag. Each hook member is configured to communicate in a similarly configured hook cavity on the opposing sides of the template.

Still another alternative embodiment of the present invention contemplates the positioning of first and second, lateral dispenser bars, configured to communicate with lateral apertures at opposing sides of the bag stack.

2. Prior Art & General Background

While the prior art has contemplated a variety cf thermoplastic bag dispenser systems, none apparently has contemplated the utilization of friction means for urging the dispensed bag into the open position during the dispensing process.

A list of prior patents which may be of interest is presented below:

| Patent No. | Patentee(s) | Issue Date |
|---|---|---|
| 3,640,450 | Lieberman | 02/1972 |
| 4,476,979 | Reimann et al | 10/1984 |
| 4,493,419 | Prader et al | 01/1985 |
| 4,595,389 | Lehmacher | 06/1986 |
| 4,613,988 | Maddock | 09/1986 |
| 4,759,639 | DeMatteis | 07/1988 |

As may be discerned by a review of the patents supra, the prior art fails to contemplate a bag dispenser system configured for dispensing bags in an individual, open capacity, in which the system utilizes friction means for communicating with the second, lower wall of the bag, while the upper, first wall of the bag is being removed in longitudinal fashion from the bag stack and container.

Use of the container in a dispensing capacity for thermoplastic bags is not entirely new. For example, Cuppies® of La Mirada, California sells a thermoplastic bag dispensing system wherein the container is utilized for dispensing the bags.

However, the Cupples® and other known like systems do not teach the longitudinal dispensing of the bags through an end of the container and do not contemplate the frictional template system of the present invention. The Cupples® system uses a bag pack which is laterally dispensed through the upper side of the container, the system relying upon perforated release tabs affixed to the container to hold the bags together in the stack.

U.S. Pat. No. 4,759,639 issued in 1988 to DeMatteis teaches what is believed to be the some of the technology utilized in the Cupples® dispensing system discussed supra. Unlike the present invention, the '639 system requires the tearing off of tabs on the bags during the release process, which may weaken the bag structure, causing failure of the bag.

In fact, all of the above disclosed patents teach dispensing systems which include in some degree tabs or perforated areas in their respective bag stacks for dispensing of each bag, increasing the possibility of failure for these systems.

As earlier indicated, the dispensing of the bags from the container in the Cupples® embodiment must be done in a lateral fashion relative to the container, which may not be optimal as it requires typically an awkward placement of the container relative to the user, who must grasp the bag to be dispensed, lifting it in an upward, lateral fashion relative to the container, removing the bag, then moving and positioning the bag relative to the loading area. Because the bag must be more or less lifted laterally from the top of the container, the container must be placed near the user, typically interfering with operations in the bag loading area.

This is opposed to the longitudinal dispensing system of the invention, wherein the user merely grasps the bag, pulls it towards him and, having dispensed the bag through the end of the container, loads same.

As thermoplastic bags tend to rupture with the slightest cut, it is suggested that the optimal bag dispensing system is one which eliminates the requirement of using release tabs and perforations, thereby avoiding the possibility of defect. While the prior art fails in this regard, the present invention provides a cost effective, environmentally sound, and safe system for dispensing bags, wherein the bags are conveniently dispensed whole and without tabs or perforations, decreasing the probability of rupture, as well as excess waste plastic, in the form of unused tab material.

3. General, Summary Discussion of the Invention

The present invention overcomes the prior art problems discussed supra, by providing a system which is highly reliable and simple to operate, environmentally sound, and relatively cost effective.

The present invention provides a system for dispensing a bag from a stack, wherein the shipping container itself is utilized as the dispensing apparatus, thereby providing a more efficient use of resources. Unlike the prior art, the present invention utilizes an unique, frictional template, dispensing mechanism which is inexpensive to manufacture and easily recycled.

The present invention contemplates the dispensing of thermoplastic bags on an individual basis, with the dispensed bag being provided in an open disposition for loading, for example, groceries in a supermarket checkout counter environment. The method of dispensing bags as taught in the present invention is in itself new and unique, with the user grasping the handle of the upper wall of the bag to be dispensed, directing the bag in a longitudinal fashion through a bag dispensing area, wherein the second, lower wall of the bag communicates frictionally between two template members, urging the bag's mouth to form into an open disposition by the time the bag is dispensed.

An alternative embodiment of the present invention teaches a bag dispenser system similar to that contemplated in the preferred embodiment, but with the addition of hook configured members formed at opposing side ends of the open mouth of the bag, the hook configured members being configured to communicate with similarly formed hook cavities in the template members, provided for increasing the frictional communication between the dispensed bag and the template system. This alternative embodiment enhances the frictional contact between the bag being dispensed and the template system, particularly with larger bags.

Unlike the prior art, the present system provides a longitudinal means for dispensing the bags from the container, allowing the container to be placed in a relatively out-of-the-way fashion, leaving the bag loading area unencumbered. The user merely grasps the top wall of the next bag to be dispensed, pulls it towards him or her, wherein the bag is pulled in longitudinal fashion through the dispensing end of the container, and, once removed, is provided in an open position in the bag loading area, ready for loading.

Further, the present invention provides a system wherein the bags are dispensed without the necessity of tear-off tabs or the like, which tab areas increase the propensity for failure of the bags. This is desirable as plastic bag failure costs the industry hundreds of thousands, and perhaps millions, of dollars a year in damage claims due to ruptured bags, which claims can be avoided through a stronger, more consistent design, as in the present invention.

Still another alternative embodiment of the present invention may be utilized with or without the template members. This second alternative embodiment comprises a longitudinal bag dispensing system wherein the container is utilized in a dispensing capacity, like the preferred embodiment of the invention, but utilizing first and second lateral dispensing bars, which bars communicate with laterally configured rupture cavities in the opposing side ends of the bag stack. This alternative embodiment relies upon the bag material itself in establishing the resistive force to urge the second wall of the bag back during the dispensing process, dispensing the bag in an open disposition.

This alternative embodiment is structurally and operationally distinguishable from the '639 patent, as the present invention does not utilize or require tabs of any sort in the dispensing operation, which operation further utilizes a longitudinal action, as opposed to the '639's contemplated, generally lateral dispensing action.

It is therefore an object of the present invention to provide a bag dispensing system wherein the container is utilized in a dispensing capacity.

It is another object of the present invention to provide a bag dispensing system wherein there is provided a frictional means for urging the dispensed bag into an open disposition upon dispensing.

It is still another object of the present invention to provide a bag dispensing system comprising a stack of bags situated about a container and template system, wherein each bag is individually dispensed in longitudinal fashion through a dispensing port out of one end of the container.

It is another object of the present invention to provide a bag dispensing system wherein there is provided, at opposing side ends at the open mouth of the bag, hook members configured to communicate in lateral fashion with like configured hook cavities formed in communicating template members.

It is another object of the present invention to utilize a template system comprised of a frictional surface, the frictional surface being configured to communicate with a bag juxtaposed therebetween during dispensing, the template being configured for frictionally engaging the lower bag wall, urging the separation of the upper and lower bag walls and the mouth area of the bag during its passage therethrough, thereby dispensing the bag in an open disposition.

It is an object of the present invention to provide a bag dispensing system wherein there may be utilized a variety of frictional means for urging the bag to be dispensed in an open disposition.

It is another object of the present invention to provide a bag dispensing system wherein there may be utilized static electricity attractive forces, for urging the bag to be dispensed in an open disposition.

It is another object of the present invention to provide a bag dispensing system which dispenses bags in a longitudinal direction relative to its container, increasing the efficiency of the dispensing process.

It is yet another object of the present invention to provide a bag dispensing system which does not require the utilization of tabs, perforations or the like.

It is another object of the present invention to provide a second alternative embodiment wherein there is provided first and second dispensing bars laterally communicating with the bag stack at opposing side ends of the bag via lateral rupture cavities, allowing the longitudinal dispensing of individual bags from a bag stack with or without template members.

Lastly, it is an object of the present invention to provide a bag dispensing system which may be utilized with a variety of differently configured thermoplastic bags.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE EXEMPLARY EMBODIMENTS

Figure 1:
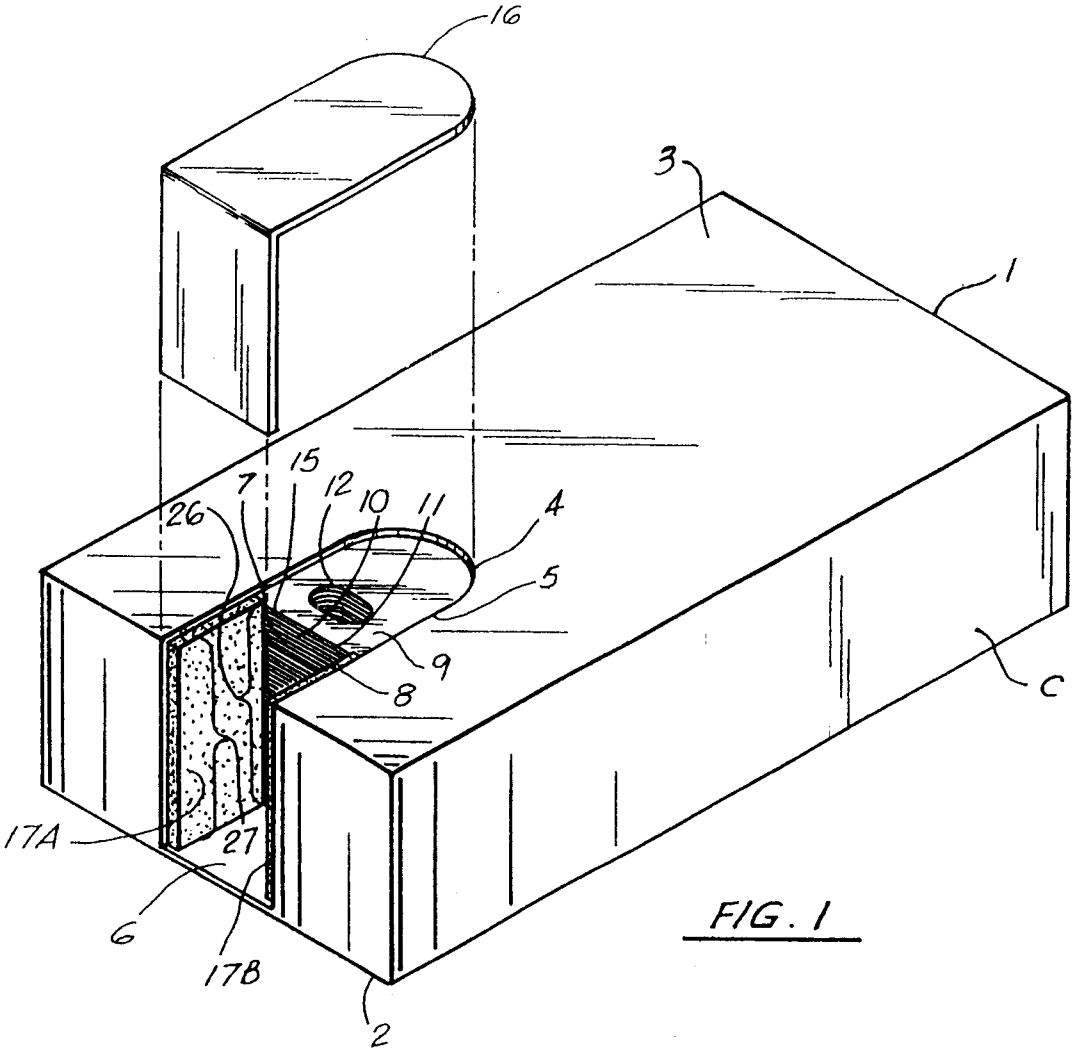
FIG. 1 is an isometric view of a first, preferred, exemplary embodiment of the bag pack dispenser system of the present invention, illustrating the bag stack, container, dispenser door, template/spacer, and the positional relationships between the various components, with the dispenser door being shown in exploded array with respect to the container.
Figure 4:
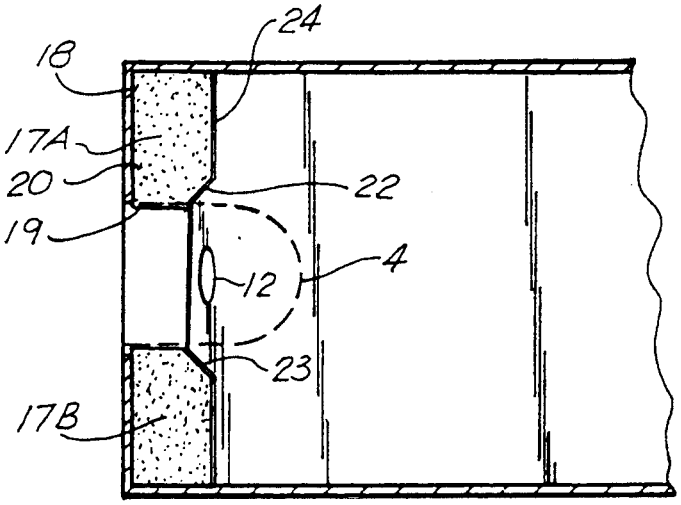
FIG. 4 is a top, partially cutaway view of the embodiment of FIG. 1, illustrating the container, bag stack, and template arrangement in their storage configuration.

As shown in FIGS. 1 and 4, the first, exemplary embodiment of the present invention includes a container C having first (1) and second (2) ends and a top side 3. As can be seen in the figures, the container C is oblong with the removable cover 16 at one of the longer ends.

A curved, "U" shaped perforation line 4 is included across a median part of the top side 3, with the perforated, removable area defining a bag grasping area 5 configured to mate with the removable, perforated cover portion 16, which is removable by the user. To make the system ready to serve as a bag dispenser, the cover 16 is removed, forming a bag dispensing area 6 in the front end 2 and top 3 of the container C.

Included within the container C is a bag stack 7 comprising a plurality of stacked, individual, identical, plastic bags 8, the preferred embodiment of which includes first (15) and second ends. The first end 16 of each bag 8 includes an elevated handle area 9 and a handle aperture 12, each bag further including first (10) and second (11) walls.

Also provided in container C are templates 17A, 17B (note FIG. 4), each having first, outer (18) and second, inner (19) ends and first, outer (20) and second, inner (24) sides. The templates 17A, 17B are situated between the second end wall 2 of container C and the bag stack 7, the first side 20 of the templates 17A, 17B communicating with the second end wall 2 of container C, and the second side 24 communicating with the first end 15 of the bag stack, and are configured to provide the bag dispensing area 6 therebetween.

The second side 24 of the templates 17A, 17B further includes oblique walls 22, 23 (note FIG. 4) configured to communicate with the dimensional configuration of the first end 15 of bag stack 7. The height 27 of the templates 17A, 17B and the height 26 of bag stack 7 are generally equivalent.

The templates 17A, 17B are constructed such that their second sides 24 are comprised of a material which frictionally or otherwise engages the second end 16 of bag stack in a non-adhering but retarding fashion. The templates may be made of block styrofoam, cardboard, etc., or may be formed of folded cardboard or like material emanating from the container C.

Figure 2:
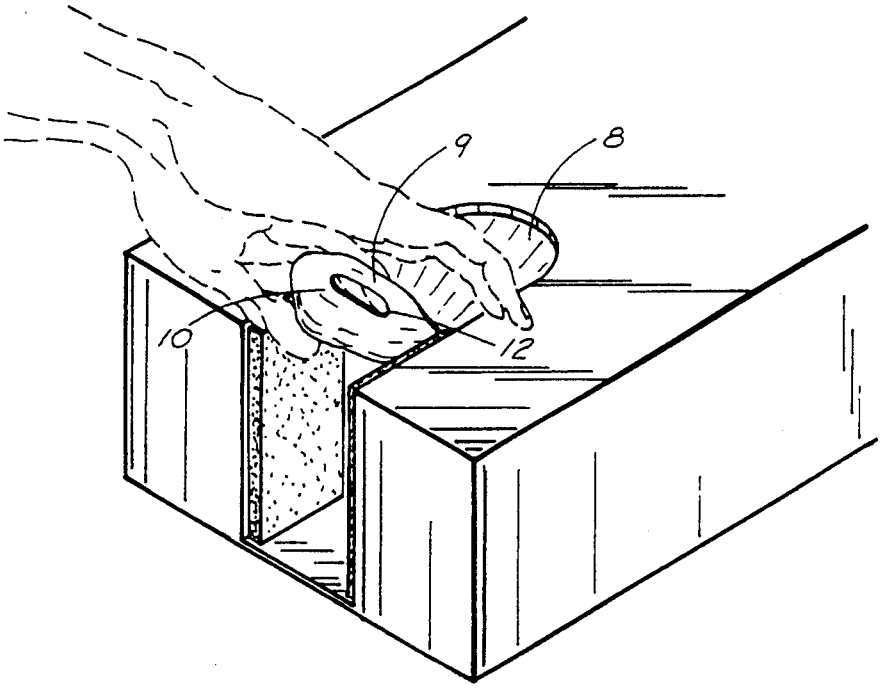
FIG. 2 is a further isometric view of the embodiment of FIG. 1, illustrating the first step in the method of dispensing a bag, wherein the user applies digital pressure upon the raised handle area of the first, upper wall of the top bag to be dispensed.
Figure 3:
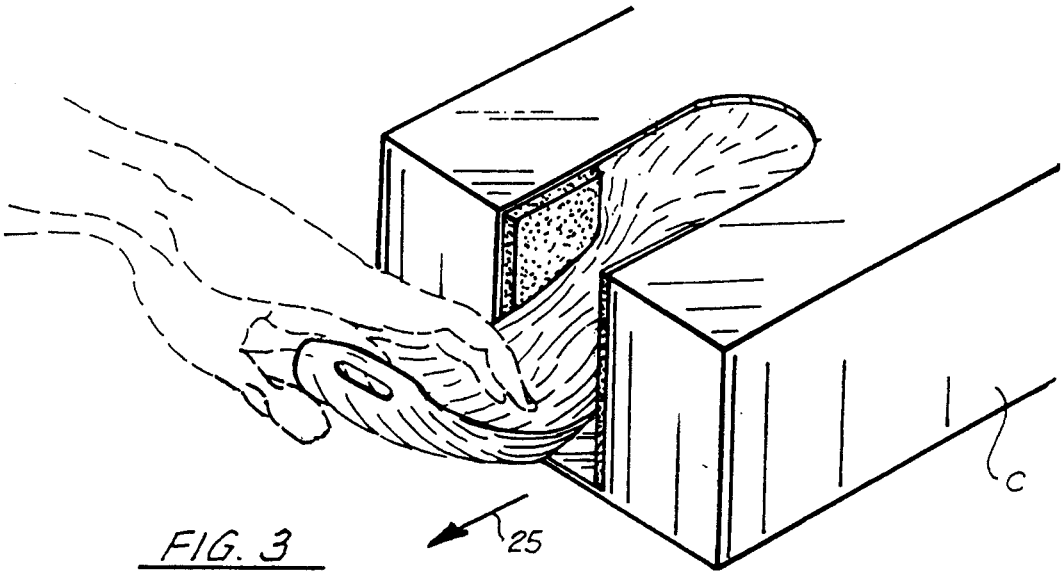
FIG. 3 is a still further isometric view of the embodiment of FIG. 1, illustrating the second step in the method of dispensing a bag, wherein the user longitudinally pulls the raised handle area of the first, upper wall of the bag being dispensed through the dispensing port, and away from the container.

In use, the user removes that portion of the upper, top side 3 and end side of the container C as allowed via the perforation 4, exposing the bag dispensing area 6. As shown in FIGS. 2, 3 and 4 of the drawings, in dispensing the bag the user merely places his finger(s) upon the elevated handle area 9 of the first wall 10 of the top bag 8, applying downward pressure, while pulling the first wall 10 in a longitudinal fashion (note direction arrow 25) toward him relative to the container C.

Figure 5:
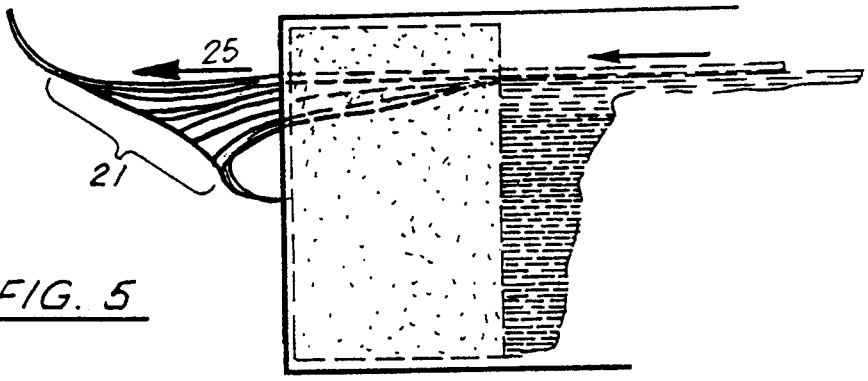
FIG. 5 is a side, partially cut-away view of the embodiment of FIG. 1, illustrating the positional relationship of an exemplary bag being dispensed relative to the container and template arrangement.
Figure 6:
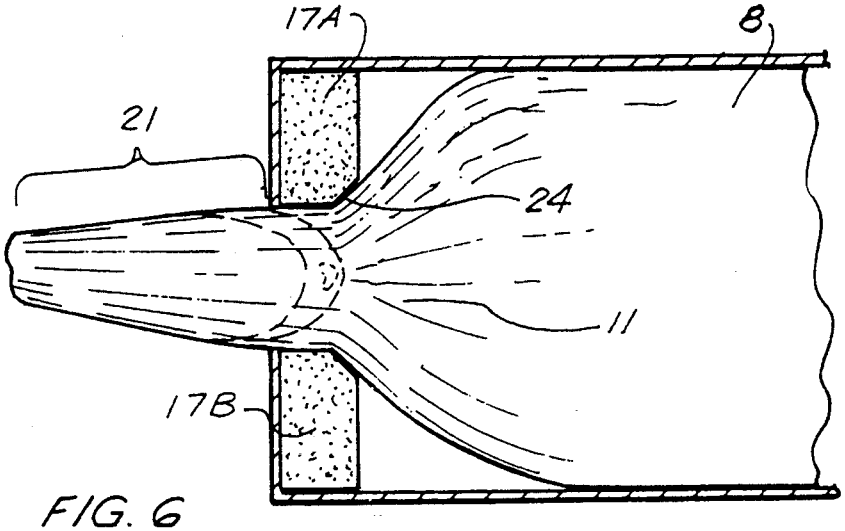
FIG. 6 is a top, partially cutaway view of the embodiment of FIG. 1, illustrating the dispensing of the top bag of the bag stack, and in particular the frictional communication of the second, lower wall of the stack with the templates during the dispensing process.

As shown in FIGS. 5 and 6 of the drawings, the user's pulling the first wall 10 of the bag longitudinally (25) through the dispensing area 6 allows the second wall 11 of the bag 8 to frictionally communicate with the second side 24 of the templates 17A, 17B, encouraging and causing spacial separation between first wall 10 and second wall 11 to occur.

The first wall 10 is pulled from the container, with second wall 11 frictionally urged between templates 17A, 17B, until the combined linear width span of the first (10) and second (11) walls is exhausted, whereby the second wall 11 of the bag finally has enough pulling force (25) directed to it to urge it from the box, thereby providing a dispensed bag having a fully open mouth area 21, ready for loading.

Figure 7:
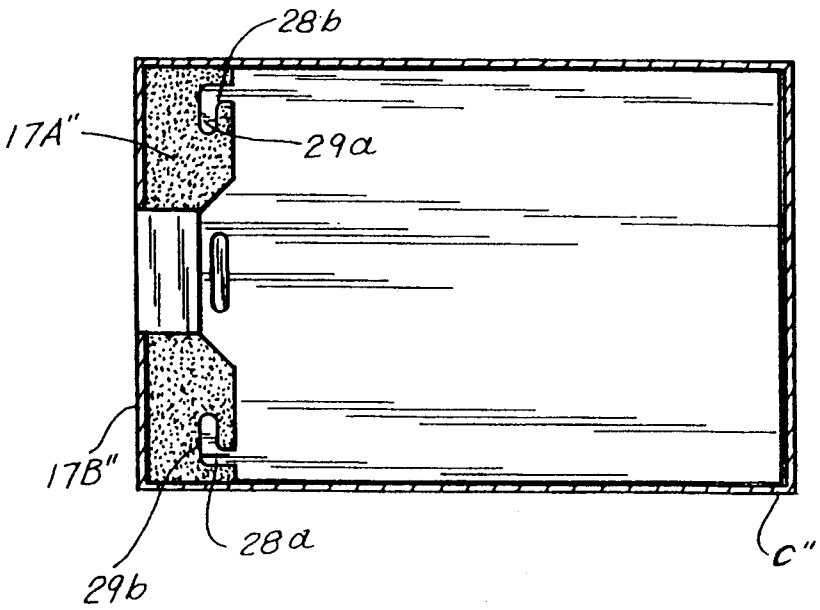
FIG. 7 is a top, partially cutaway view of a first alternative embodiment of the invention (similar in perspective to that of FIG. 4 of the first embodiment), wherein there is incorporated "hook" configured appendages emanating from opposed ends of the open mouth portion of the bags, the appendages being configured to communicate with like formed cavities in the template system.

As shown in FIG. 7, a first alternative embodiment of the present invention teaches the forming and utilization of hook elements 28*a*, 28*b* emanating from the opposed ends of each bag at the mouth opening, the hook elements communicating with similarly configured cavities 29*a*, 29*b*, formed in the templates 17A", 17B", respectively. This alternative embodiment provides additional frictional communication between the bag being pulled and the templates, for the enhanced removal of the bag from the container C'' in an open configuration or disposition.

In use, the alternative embodiment of FIG. 7 is dispensed in a fashion similar to that disclosed with regard to the preferred embodiment of FIGS. 1–6, the difference being that slightly more longitudinal force may have to be applied in removing the bag from the container in order to overcome the additional friction generated during the removal of the hook members.

Figure 8:
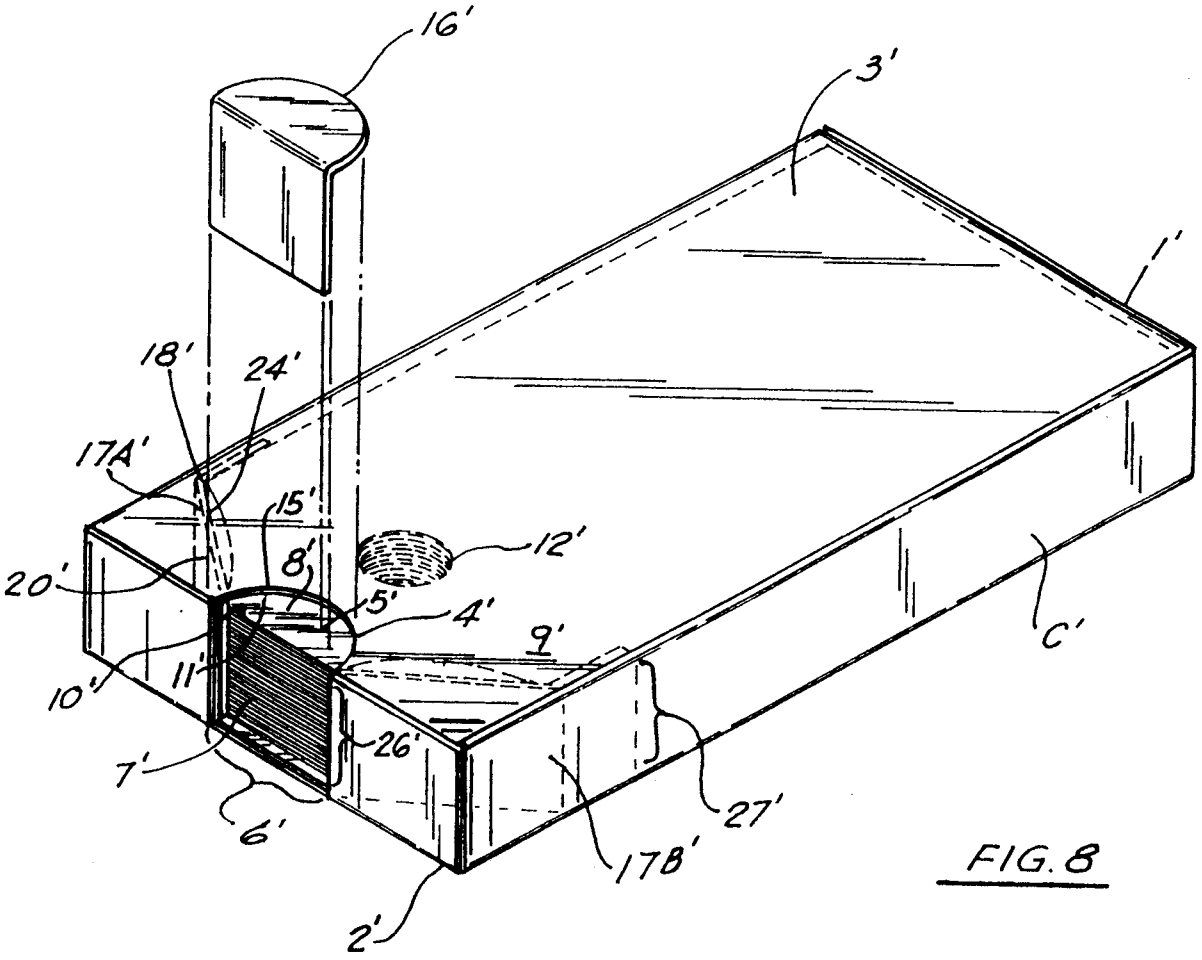
FIG. 8 is an isometric view of a second alternative embodiment of the bag pack dispenser system of the present invention, illustrating the bag stack, container, dispenser door, templates, and the positional relationships between the various components, with some of the elements being illustrated in phantom line.

FIG. 8 illustrates a second alternative embodiment of the present invention, wherein there is provided a dual lateral dispenser bar arrangement for assisting in the uniform dispensing of the bags. As shown in FIG. 8, the present invention includes a container C' having first 1' and second 2' ends, and a top 3' side, wherein there is further provided a perforation 4' across the top 3' side, the perforation having a bag grasping area 5' and configured to have portion 16' removable by the user, forming a bag dispensing area 6', once the system is ready for application, like the preferred embodiment.

Contained by container C' is bag stack 7' comprising a plurality of individually stacked bags 8', the preferred embodiment of which includes first (15') and second ends, the first end including an elevated handle area 9' and a handle aperture 12', the bag further including first (10') and second (11') walls.

Also provided in container C' are templates 17A', 17B' each having first, outer (18') and second, inner (19') ends and first, outer (20') and second, inner (24') sides. The templates 17A', 17B' are situated between the second end wall 2' of the container C' and the bag stack 7' the second, inner ends 19' of the templates 17A', 17B' communicating with the second end wall 2' of the container C', and the second side 24' communicating with the first end 15' of the bag stack. The templates 17A', 17B' are further situated to provide the bag dispensing area 6' therebetween.

The second side 24' of the templates 17A', 17B' may be configured to communicate with the dimensional configuration of the first end 15' of the bag stack 7'. The height 27' of the templates 17A', 17B' and the height 26' of the bag stack 7' are generally equivalent.

The templates 17A', 17B' may be constructed such that their second sides 24' are comprised of a material which frictionally or otherwise engages the second end 16' of the bag stack in a nonadhering but retarding fashion, but such is not required for the application as taught in the present, exemplary embodiment of the invention.

Figure 9:
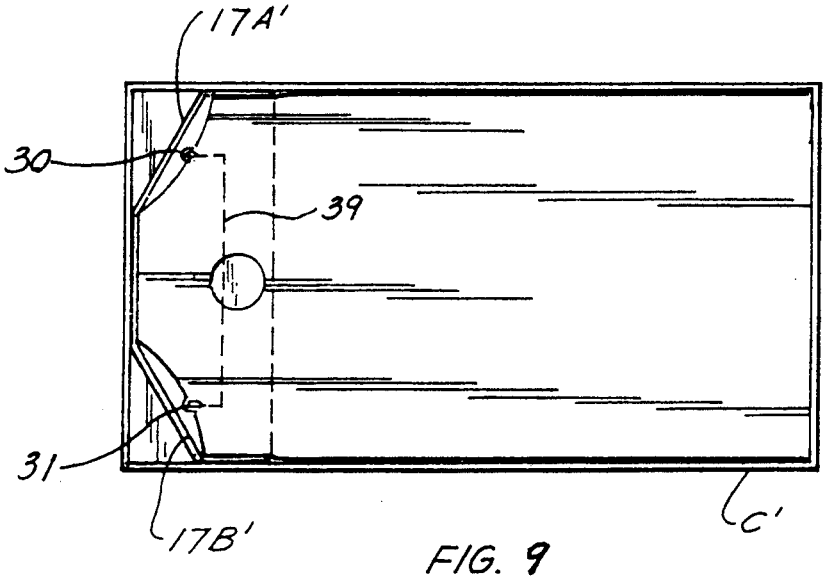
FIG. 9 is a top, partially cutaway view of the second alternative embodiment of FIG. 8, wherein there is provided first and second, vertical dispenser bars in lateral movement limiting communication with respective first and second, lateral rupture cavities provided at generally opposed, spaced portions at the first end of the bag stack.
Figure 10:
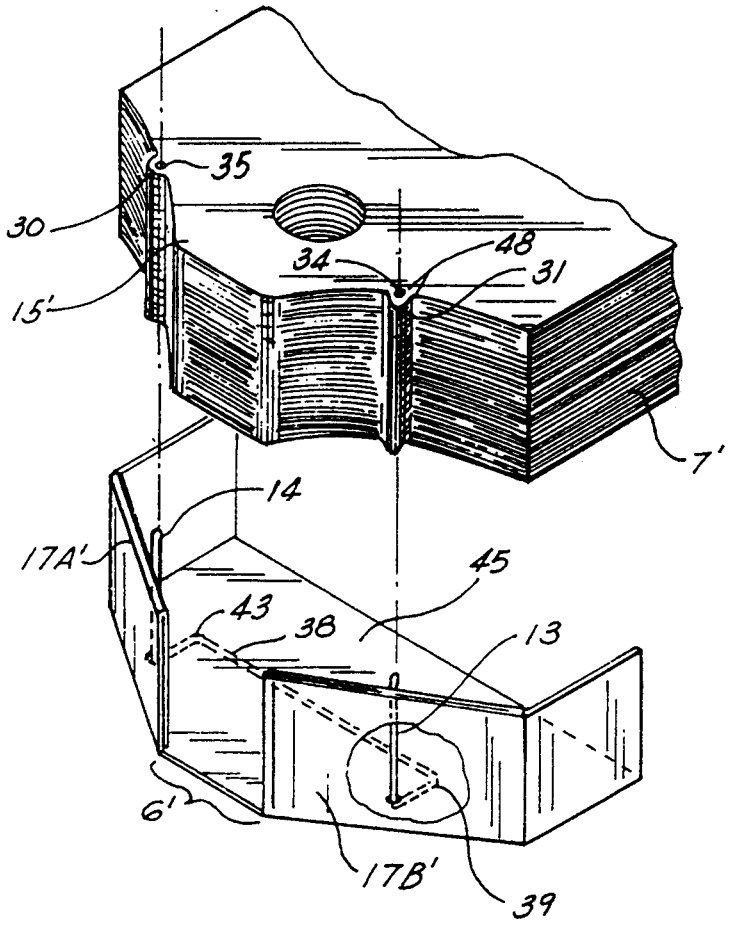
FIG. 10 is an isometric, partial, exploded view of the second alternative embodiment of FIG. 8, illustrating the placement and configuration of the vertical dispenser bars relative to the spacer arrangement and bag stack.

FIGS. 9 and 10 illustrate the dual lateral dispenser bar arrangement of the embodiment of FIG. 8, wherein the bag stack 7' has formed therein first and second lateral, rupture cavities 34, 35, each configured to allow the passage of "vertical" dispenser bars 13, 14 therethrough. As shown, the first and second dispenser bars 13 & 14 are configured to laterally communicate with respective first (34) and second (35) lateral rupture cavities formed in the bag stack, the bars being of sufficient height to at least communicate with both walls of the top bag of the stack 7'. Lateral rupture cavities 34, 35 are positioned about an eighth (⅛") inch 48 in generally opposing, spaced areas relative to the edges of the bag, and may be situated generally along the full perimeter edges of the bag stack 7'.

The dispenser bars 13, 14 are configured to emanate from generally the floor of the container C' and are formed from opposing ends of a dispenser frame 38, which has a rearwardly directed portion 39 relative to the first end 15' of the bag stack for stability, and may be made of, for example, eleven gauge metal wire.

The base 43 of the dispenser frame 38 may be positioned upon the floor of the container C' via a spacer 45 of cardboard or the like, providing a positioning capability, as well as providing further stability to the system.

In fact, the spacer 45 and the templates 17A', 17B' may be formed of a single portion of corrugated cardboard or the like, greatly simplifying the implementation of the present system, as well as decreasing costs of manufacture and assembly.

The exemplary embodiment of the present invention includes rupture cavities 34, 35 formed in appendages 30, 31 along the first end 15' of each bag. However, it is noted that the rupture cavities 30, 31 need not necessarily be formed in appendages, and may instead be formed, for further example, about the inner perimeter of the bag itself, as far as, for example, one (1") inch from the perimeter of the bag, at any spaced location.

Actually, the dual rupture cavity dispensing system as illustrated in the drawings is for exemplary purposes only, and one may utilize, for example, only a single rupture cavity arrangement, or multiple, depending upon the size of the bag being dispensed and the application therefor.

Figure 11:
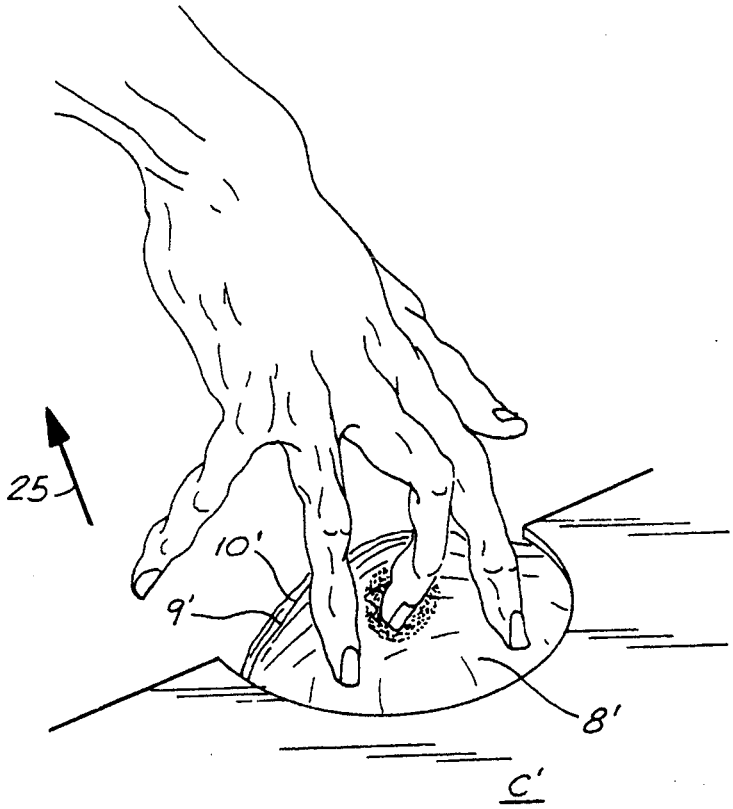
FIG. 11 is an isometric view of the second alternative embodiment of FIG. 8, illustrating the first step in the method of dispensing a bag, wherein the user applies digital pressure upon the raised handle area of the first, upper wall of the top bag.
Figure 12:
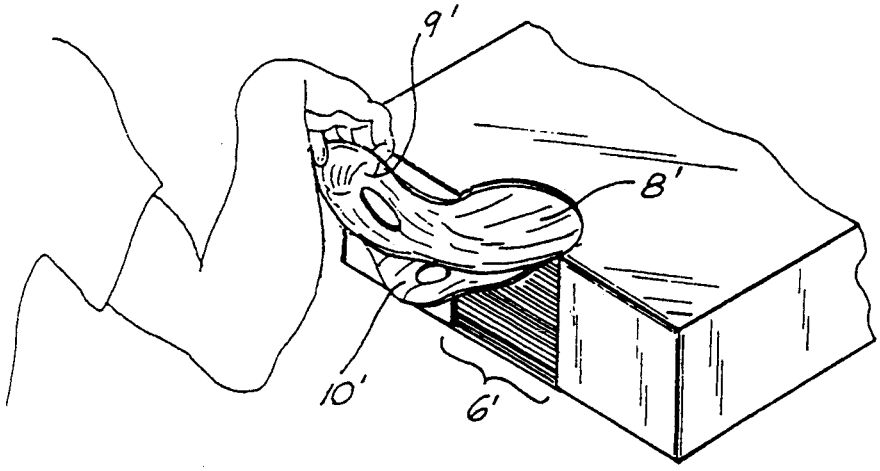
FIG. 12 is another isometric view of the second alternative embodiment of FIG. 8, illustrating the second step in the method of dispensing a bag, wherein the user longitudinally pulls the raised handle area of the first, upper wall of the top bag through the dispensing port, and away from the container, removing the bag and dispensing it in an open disposition for use.

Referring to FIGS. 11 and 12 of the drawings, in use, the user exposes the bag dispensing area 6 by lifting away the perforated removal portion (16') as discussed infra. In dispensing each bag, the user merely places his finger(s) upon the elevated handle area 9' of the first wall 10' of the top bag 8', applying downward pressure, while pulling the first wall 10' in a longitudinal fashion (note direction arrow 25') toward him relative to tine container C'.

As the user applies longitudinal (25') pulling force to the bag 8', the rupture cavities 34, 35 of the top wall of the bag 7' communicate with first and second dispenser bars 13 & 14, respectively, ultimately rupturing the cavities 34, 35, and tearing the eighth (⅛") inch space 48, releasing the first wall of the bag from the dispenser bars and freeing it.

The top wall of the bag 7' is thereby freely directed out of the dispenser port 6', until the linear width span of the first wall is exhausted, and there exists sufficient longitudinal force to direct the second wall of the bag toward the dispensing port 6', thereby again causing the rupture cavities along the second wall of the bag 10' to communicate with the first and second dispenser bars 13, 14, tearing the eighth (⅛") inch space 48, and releasing the bag in an open configuration or disposition, ready for loading.

It is noted that the eighth (⅛") inch spaces 48, 49, as with all measurements indicated, is for exemplary purposes only, and will vary depending upon the application, material, scale, and bag configuration.

Exemplary Measurements

| Description | Measurements |
|---|---|
| Container | 6" high × 12" wide × 24" deep |
| Dispenser Port | 6" high × 5" wide (at box end) |
| | 5" wide × 4" deep (on top side) |
| Bag | 11.75" wide × 21" deep |
| Height of Bag Stack | 5.50" height |
| Templates | 5.75" high × 4" wide × 3" deep |
| Oblique Wall angle | forty-five (45°) degrees |

Exemplary Materials

| Description | Material |
|---|---|

-continued

| | |
|---|---|
| Container | cardboard |
| Bag | polyurethane |
| Template | polystyrene foam (Styrofoam ®) |
| Lateral dispenser bar frame | 11 gauge steel wire |

The embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A bag pack dispenser system, comprising:

a container having a first end juxtaposed first and second edge sides and a top side, said container further having a dispenser port formed in a portion of said first end and a portion of said top side, said dispenser port being substantially medially situated relative to said first and second edge sides;

a bag stack formed of a plurality of individual, separable bags, each of said bags having a first, upper and a second, lower wall and a first end; and first and second template members situated inside said container, said template members juxtaposed to said first end of said bags and said first end of said container, said first and second template members having a space formed between them, providing a longitudinal dispensing channel formed from said dispenser port to said first end of said bags, said template members having a second side communicating with said first end of said bags, at least a portion of said second side comprising an oblique wall area relative the longitudinal axis of said container, said second side of said template members having a frictionally enhanced surface thereon tending to resist the movement of the lower wall of a bag being dispensed from said stack through said dispenser port, separating it from the upper wall of the bag, tending to cause the dispensed bag to emerge from said container in an open disposition.

2. The bag pack dispenser system of claim 1, wherein said bags further include:

a handle area generally medially situated relative said first end of each of said bags.

3. The bag pack dispenser system of claim 1, wherein said container further includes:

a perforated, removable portion configured to provide said dispenser port upon its removal from said container.

4. The bag pack dispenser system of claim 1, wherein said template members are made from polystyrene foam.

5. The bag pack dispenser system of claim 1, wherein said template members are of substantially the same height as the height of said bag stack.

6. The bag pack dispenser system of claim 1, wherein said bags further include:

generally hook-configured appendages emanating from opposed ends of said first side of each of said bags.

7. The bag pack dispenser system of claim 6, wherein said template members have formed therein generally hook-configured cavities further configured to envelope said hook-configured appendages of said bags.

8. The bag pack dispenser system of claim 3, wherein said dispenser port is formed via a removable portion perforated about its periphery.

9. The bag pack dispenser system of claim 8, wherein each of said bags further include:

a handle area generally medially situated relative to said first end of each of said bags; and wherein said dispenser port is configured to expose said handle areas of said bags.

10. A bag pack dispenser system, comprising:

a container having a first end juxtaposed first and second edge sides and a top side, said container further having a dispenser port formed in a portion of said first end and a portion of said top side, said dispenser port medially situated relative to said first and second edge sides;

a bag stack formed of a plurality of individual, separable bags, each of said bags having a first and second wall, and a first end; and first and second frictional areas situated inside said container, said frictional areas juxtaposed to said first end of said bags and said first end of said container, said first and second frictional areas having a space formed between the first and second frictional areas, such that there is provided a longitudinal dispensing channel formed from said dispenser port to said first end of said bags, said frictional areas having a wall communicating with said first end of said bags, at least a portion of said wall comprising an oblique wall area relative the longitudinal axis of said container, said wall of said frictional areas further having formed thereon a frictional surface.

11. The bag pack dispenser system of claim 10, wherein said bags further comprise a handle area situated relative to said first end of said bags.

12. The bag pack dispenser system of claim 10, wherein said container further includes a perforated area for providing said dispenser port.

13. The bag pack dispenser system of claim 10, wherein said frictional surfaces are of generally equivalent height to the height of said bag stack.

14. The bag pack dispenser system of claim 10, wherein said bag members further comprise generally hook-configured appendages emanating from opposed ends of said first sides of said bags.

15. The bag pack dispenser system of claim 14, wherein said frictional areas have formed therein generally hook-configured cavities further configured to envelope said hook-configured appendages of said bag members.

16. The bag pack dispenser system of claim 12, wherein said dispenser port is formed via a removable portion perforated about its periphery.

17. The bag pack dispenser system of claim 16, wherein said dispenser port is configured to expose said handle areas of said bags.

18. The bag pack dispenser system of claim 17, wherein at least a portion of said first end of said container has formed therein a wall area situated obliquely relative to the longitudinal axis of said container, said wall area in communication with the dispenser port of said container.

19. The bag pack dispenser of claim 1, wherein said container's length is greater than its width.

20. The bag pack dispenser of claim 10, wherein said container's length is greater than its width.

* * * * *